US008209190B2

(12) United States Patent
Ashley et al.

(10) Patent No.: US 8,209,190 B2
(45) Date of Patent: Jun. 26, 2012

(54) METHOD AND APPARATUS FOR GENERATING AN ENHANCEMENT LAYER WITHIN AN AUDIO CODING SYSTEM

(75) Inventors: James P. Ashley, Naperville, IL (US); Jonathan A. Gibbs, Winchester (GB); Udar Mittal, Hoffman Estates, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 907 days.

(21) Appl. No.: 12/187,423

(22) Filed: Aug. 7, 2008

(65) Prior Publication Data

US 2009/0112607 A1 Apr. 30, 2009

Related U.S. Application Data

(60) Provisional application No. 60/982,566, filed on Oct. 25, 2007.

(51) Int. Cl.
*G10L 21/00* (2006.01)
*G10L 21/04* (2006.01)
*G10L 19/00* (2006.01)

(52) U.S. Cl. ..... 704/501; 704/201; 704/205; 704/206; 704/270; 704/500

(58) Field of Classification Search ..... 704/201, 704/205, 206
See application file for complete search history.

(56) References Cited

U.S. PATENT DOCUMENTS 4,560,977 A 12/1985 Murakami et al.
4,670,851 A 6/1987 Murakami et al.
4,727,354 A 2/1988 Lindsay
4,853,778 A 8/1989 Tanaka
5,006,929 A 4/1991 Barbero et al.
5,067,152 A 11/1991 Kisor et al.
5,268,855 A 12/1993 Mason et al.
5,327,521 A 7/1994 Savic et al.
5,394,473 A 2/1995 Davidson
5,956,674 A * 9/1999 Smyth et al. ..... 704/200.1
5,974,435 A 10/1999 Abbott (Continued)

FOREIGN PATENT DOCUMENTS

EP 1483759 B1 8/2004

(Continued)

OTHER PUBLICATIONS

Ramprashad, "High Quality Embedded Wideband Speech Coding Using an Inherently Layered Coding Paradigm," Proceedings of International Conference on Acoustics, Speech, and Signal Processing, ICASSP 2000, vol. 2, Jun. 5-9, 2000, pp. 1145-1148.

(Continued)

*Primary Examiner* — Justin Rider

(57) ABSTRACT

During operation an input signal to be coded is received and coded to produce a coded audio signal. The coded audio signal is then scaled with a plurality of gain values to produce a plurality of scaled coded audio signals, each having an associated gain value and a plurality of error values are determined existing between the input signal and each of the plurality of scaled coded audio signals. A gain value is then chosen that is associated with a scaled coded audio signal resulting in a low error value existing between the input signal and the scaled coded audio signal. Finally, the low error value is transmitted along with the gain value as part of an enhancement layer to the coded audio signal.

17 Claims, 7 Drawing Sheets

400

U.S. PATENT DOCUMENTS

| | | | | |
|---|---|---|---|---|
| 6,108,626 | A | 8/2000 | Cellario et al. | |
| 6,236,960 | B1 | 5/2001 | Peng et al. | |
| 6,253,185 | B1 * | 6/2001 | Arean et al. | 704/500 |
| 6,263,312 | B1 * | 7/2001 | Kolesnik et al. | 704/500 |
| 6,304,196 | B1 | 10/2001 | Copeland et al. | |
| 6,453,287 | B1 | 9/2002 | Unno et al. | |
| 6,493,664 | B1 | 12/2002 | Udaya Bhaskar et al. | |
| 6,504,877 | B1 | 1/2003 | Lee | |
| 6,593,872 | B2 * | 7/2003 | Makino et al. | 341/200 |
| 6,658,383 | B2 | 12/2003 | Koishida et al. | |
| 6,662,154 | B2 | 12/2003 | Mittal et al. | |
| 6,691,092 | B1 | 2/2004 | Udaya Bhaskar et al. | |
| 6,704,705 | B1 * | 3/2004 | Kabal et al. | 704/230 |
| 6,813,602 | B2 | 11/2004 | Thyssen | |
| 6,940,431 | B2 | 9/2005 | Hayami | |
| 6,975,253 | B1 | 12/2005 | Dominic | |
| 7,031,493 | B2 | 4/2006 | Fletcher et al. | |
| 7,130,796 | B2 | 10/2006 | Tasaki | |
| 7,161,507 | B2 | 1/2007 | Tomie | |
| 7,180,796 | B2 | 2/2007 | Tanzawa et al. | |
| 7,212,973 | B2 * | 5/2007 | Toyama et al. | 704/500 |
| 7,230,550 | B1 | 6/2007 | Mittal et al. | |
| 7,231,091 | B2 | 6/2007 | Keith | |
| 7,414,549 | B1 | 8/2008 | Yang et al. | |
| 7,461,106 | B2 | 12/2008 | Mittal et al. | |
| 7,761,290 | B2 | 7/2010 | Koishida et al. | |
| 7,840,411 | B2 | 11/2010 | Hotho et al. | |
| 7,885,819 | B2 | 2/2011 | Koishida et al. | |
| 7,889,103 | B2 | 2/2011 | Mittal et al. | |
| 2002/0052734 | A1 | 5/2002 | Unno et al. | |
| 2003/0004713 | A1 * | 1/2003 | Makino et al. | 704/230 |
| 2003/0009325 | A1 * | 1/2003 | Kirchherr et al. | 704/211 |
| 2003/0220783 | A1 | 11/2003 | Streich et al. | |
| 2004/0252768 | A1 | 12/2004 | Suzuki et al. | |
| 2005/0261893 | A1 * | 11/2005 | Toyama et al. | 704/201 |
| 2006/0022374 | A1 | 2/2006 | Chen et al. | |
| 2006/0173675 | A1 | 8/2006 | Ojanpera | |
| 2006/0190246 | A1 | 8/2006 | Park | |
| 2006/0241940 | A1 * | 10/2006 | Ramprashad | 704/229 |
| 2007/0171944 | A1 | 7/2007 | Schuijers et al. | |
| 2007/0239294 | A1 * | 10/2007 | Brueckner et al. | 700/94 |
| 2007/0271102 | A1 | 11/2007 | Morii | |
| 2008/0065374 | A1 | 3/2008 | Mittal et al. | |
| 2008/0120096 | A1 | 5/2008 | Oh et al. | |
| 2009/0024398 | A1 | 1/2009 | Mittal et al. | |
| 2009/0030677 | A1 | 1/2009 | Yoshida | |
| 2009/0076829 | A1 * | 3/2009 | Ragot et al. | 704/500 |
| 2009/0100121 | A1 | 4/2009 | Mittal et al. | |
| 2009/0234642 | A1 | 9/2009 | Mittal et al. | |
| 2009/0259477 | A1 | 10/2009 | Ashley et al. | |
| 2009/0306992 | A1 | 12/2009 | Ragot et al. | |
| 2009/0326931 | A1 | 12/2009 | Ragot et al. | |
| 2010/0088090 | A1 | 4/2010 | Ramabadran | |
| 2010/0169087 | A1 | 7/2010 | Ashley et al. | |
| 2010/0169099 | A1 | 7/2010 | Ashley et al. | |
| 2010/0169100 | A1 | 7/2010 | Ashley et al. | |
| 2010/0169101 | A1 | 7/2010 | Ashley et al. | |

FOREIGN PATENT DOCUMENTS

| | | | |
|---|---|---|---|
| EP | 1533789 | A1 | 5/2005 |
| EP | 0932141 | B1 | 8/2005 |
| EP | 1619664 | A1 | 1/2006 |
| EP | 1818911 | A1 | 8/2007 |
| EP | 1 845 519 | A2 | 10/2007 |
| EP | 1912206 | A1 | 4/2008 |
| EP | 1959431 | B1 | 6/2010 |
| RU | 2137179 | C1 | 9/1999 |
| WO | 9715983 | A1 | 5/1997 |
| WO | 03073741 | A2 | 9/2003 |
| WO | 2007012794 | A2 | 2/2007 |
| WO | 2007063910 | A1 | 6/2007 |
| WO | 2010003663 | A1 | 1/2010 |

OTHER PUBLICATIONS

Ramprashad, "A Two Stage Hybrid Embedded Speech/Audio Coding Structure," Proceedings of Internationnal Conference on Acoustics, Speech, and Signal Processing, ICASSP 1998, May 1998, vol. 1, pp. 337-340, Seattle, Washington.

International Telecommunication Union, "G.729.1, Series G: Transmission Systems and Media, Digital Systems and Networks, Digital Terminal Equipments—Coding of analogue signals by methods other than PCM,G.729 based Embedded Variable bit-rate coder: An 8-32 kbit/s scalable wideband coder bitstream interoperable with G.729," ITU-T Recomendation G.729.1, May 2006, Cover page, pp. 11-18. Full document available at: http://www.itu.int/rec/T-REC-G.729.1-200605-I/en.

Kovesi, et al., "A Scalable Speech and Adiuo Coding Scheme with Continuous Bitrate Flexibility," Proceedings of the IEEE International Conference on Acoustics, Speech and Signal Processing 2004 (ICASSP '04) Montreal, Quebec, Canada, May 17-21, 2004, vol. 1, pp. 273-276.

Ramprashad, "Embedded Coding Using a Mixed Speech and Audio Coding Paradigm," International Journal of Speech Technology, Kluwer Academic Publishers, Netherlands, vol. 2, No. 4, May 1999, pp. 359-372.

Elko Zimmermann, "PCT International Search Report and Written Opinion," WIPO, ISA/EPO, Netherlands, Dec. 15, 2008.

Patent Cooperation Treaty, "PCT Search Report and Written Opinion of the International Searching Authority" for International Application No. PCT/US2009/066627 Mar. 5, 2010, 13 pages.

Kim et al.; "A New Bandwidth Scalable Wideband Speech/Aduio Coder" Proceedings of Proceedings of International Conference on Acoustics, Speech, and Signal Processing, ICASSP; Orland, FL; ; vol. 1, May 13, 2002 pp. 657-660.

Patent Cooperation Treaty, "PCT Search Report and Written Opinion of the International Searching Authority" for International Application No. PCT/US2009/066507 Mar. 16, 2010, 14 pages.

Hung et al., Error-Resilient Pyramid Vector Quantization for Image Compression, IEEE Transactions on Image Processing, 1994 pp. 583-587.

Daniele Cadel, et al. "Pyramid Vector Coding for High Quality Audio Compression", IEEE 1997, pp. 343-346, Cefriel, Milano, Italy and Alcatel Telecom, Vimercate Italy.

Patent Cooperation Treaty, "PCT Search Report and Written Opinion of the International Searching Authority" for International Application No. PCT/US2009/036479 Jul. 28, 2009, 15 pages.

Markas et al. "Multispectral Image Compression Algorithms"; Data Compression Conference, 1993; Snowbird, UT USA Mar. 30-Apr. 2, 1993; pp. 391-400.

"Enhanced Variable Rate Codec, Speech Service Options 3, 68, and 70 for Wideband Spread Spectrum Digital Systems", 3GPP2 TSG-C Working Group 2, XX, XX, No. C. S0014-C, Jan. 1, 2007, pp. 1-5.

United States Patent and Trademark Office, "Notice of Allowance and Fee(s) Due" for U.S. Appl. No. 12/047,586 dated Oct. 7, 2010, 26 pages.

Patent Cooperation Treaty, "PCT Search Report and Written Opinion of the International Searching Authority" for International Application No. PCT/US2009/036481 Jul. 20, 2009, 15 pages.

Boris Ya Ryabko et al.: "Fast and Efficient Construction of an Unbiased Random Sequence", IEEE Transactions on Information Theory, IEEE, US, vol. 46, No. 3, May 1, 2000, ISSN: 0018-9448, pp. 1090-1093.

Ratko V. Tomic: "Quantized Indexing: Background Information", May 16, 2006, URL: http://web.archive.org/web/20060516161324/www.1stworks.com/ref/TR/tr05-0625a.pdf, pp. 1-39.

Ido Tal et al.: "On Row-by-Row Coding for 2-D Constraints", Information Theory, 2006 IEEE International Symposium on, IEEE, PI, Jul. 1, 2006, pp. 1204-1208.

United States Patent and Trademark Office, "Non-Final Rejection" for U.S. Appl. No. 12/047,632 dated Mar. 2, 2011, 20 pages.

Patent Cooperation Treaty, "PCT Search Report and Written Opinion of the International Searching Authority" for International Application No. PCT/US2009/039984 Aug. 13, 2009, 14 pages.

United States Patent and Trademark Office, "Non-Final Rejection" for U.S. Appl. No. 12/099,842 dated Apr. 15, 2011, 21 pages.

Ramo et al. "Quality Evaluation of the G.EV-VBR Speech Codec" Apr. 4, 2008, pp. 4745-4748.

Jelinek et al. "ITU-T G.EV-VBR Baseline Codec" Apr. 4, 2008, pp. 4749-4752.

Jelinek et al. "Classification-Based Techniques for Improving the

Robustness of Celp Coders" 2007, pp. 1480-1484.
Fuchs et al. "A Speech Coder Post-Processor Controlled by Side-Information" 2005, pp. IV-433-IV-436.
J. Fessler, "Chapter 2; Discrete-time signals and systems" May 27, 2004, pp. 2.1-2.21.
Udar Mittal et al., "Decoder for Audio Signal Including Generic Audio and Speech Frames", U.S. Appl. No. 12/844,199, filed Jul. 27, 2010.
Virette et al "Adaptive Time-Frequency Resolution in Modulated Transform at Reduced Delay" ICASSP 2008; pp. 3781-3784.
Edler "Coding of Audio Signals with Overlapping Block Transform and Adaptive Window Functions"; Journal of Vibration and Low Voltage fnr; vol. 43, 1989, Section 3.1.
Princen et al., "Subband/Transform Coding Using Filter Bank Designs Based on Time Domain Aliasing Cancellation" IEEE 1987; pp. 2161-2164.
Udar Mittal et al., "Decoder for Audio Signal Including Generic Audio and Speech Frames", U.S. Appl. No. 12/844,206, filed Sep. 9, 2010.
Patent Cooperation Treaty, "PCT Search Report and Written Opinion of the International Searching Authority" for International Application No. PCT/US2011/026660 Jun. 15, 2011, 10 pages.
Mittal, et al., "Coding Unconstrained FCB Excitation Using Combinatorial and Huffman Codes," Proceedings of the 2002 IEEE Workshop on Speech Coding, Oct. 6-9, 2002, pp. 129-131.
Ashley, et al., Wideband Coding of Speech Using a Scalable Pulse Codebook, Proceedings of the 2000 IEEE Workshop on Speech Coding, Sep. 17-20, 2000, pp. 148-150.
Mittal, et al.,"Low Complexity Factorial Pulse Coding of MDCT Coefficients using Approximation of Combinatorial Functions," IEEE International Conference on Acoustics, Speech and Signal Processing, 2007, ICASSP 2007, Apr. 15-20, 2007, pp. I-289-I-292.
3rd Gerneration Partnership Project, "3GPP TS 26.290 V7.0.0 (Mar. 2007); 3rd Generation Partnership Project; Technical Specification Group Service and System Aspects; Audio Codec Processing Functions; Extended Adaptive Multi-Rate—Wideband (AMR-WB+) Codec; Transcoding Functions," 3rd generation Partnership Project, Release 7, Mar. 2007.
Chan, et al., "Frequency Domain Postfiltering for Multiband Excited Linear Predictive Coding of Speech," Electronics Letters, Jun. 6, 1996, pp. 1061-1063.
Chen, et al., "Adaptive Postfiltering for Quality Enhancement of Coded Speech," IEEE Transactions on Speech and Audio Processing, vol. 3, No. 1, Jan. 1995, pp. 59-71.
Andersen, et al., Reverse Water-Filling in Predictive Encoding of Speech, Proceedings of the 1999 IEEE Workshop on Speech Coding, Jun. 20-23, 1999, pp. 105-107.
Makinen, et al., "AMR-WB+: A New Audio Coding Standard for 3rd Generation Mobile Audio Service," Proceedings of the IEEE International Conference on Acoustics, Speech and Signal Processing, 2005, ICASSP'05, vol. 2, Mar. 18-23, 2005, pp. ii/1109-ii/1112.
Faller, et al., "Technical Advances in Digital Audio Radio Broadcasting," Proceedings of the IEEE, vol. 90, Issue 8, Aug. 2002, pp. 1303-1333.
Salami, et al., "Extended AMR-WB for High-Quality Audio on Mobile Devices," IEEE Communications Magazine, vol. 44, Issue 5, May 2006, pp. 90-97.
Hung, et al., "Error-Resilient Pyramid Vector Quantization for Image Compression," IEEE Transactions on Image Processing, vol. 7, Issue 10, Oct. 1998, pp. 1373-1386.
Tancerel, et al., Proceedings of the 2000 IEEE Workshop on Speech Coding, Sep. 17-20, 2000, pp. 154-156.
Office Action for U.S. Appl. No. 12/345,141, mailed Sep. 19, 2011.
Office Action for U.S. Appl. No. 12/345,165, mailed Sep. 1, 2001.
Office Action for U.S. Appl. No. 12/099,842, mailed Oct. 12, 2011.
Office Action for U.S. Appl. No. 12/047,632, mailed Oct. 18, 2011.
Patent Cooperation Treaty, "PCT Search Report and Written Opinion of the International Searching Authority" for International Application No. PCT/US2011/0266400 Aug. 5, 2011, 11 pages.
Neuendorf, et al., "Unified Speech Audio Coding Scheme for High Quality oat Low Bitrates" ieee International Conference on Accoustics, Speech and Signal Processing, 2009, Apr. 19, 2009, 4 pages.

* cited by examiner

200

- PRIOR ART -

300

- PRIOR ART -

400

METHOD AND APPARATUS FOR GENERATING AN ENHANCEMENT LAYER WITHIN AN AUDIO CODING SYSTEM

FIELD OF THE INVENTION

The present invention relates, in general, to communication systems and, more particularly, to coding speech and audio signals in such communication systems.

BACKGROUND OF THE INVENTION

Compression of digital speech and audio signals is well known. Compression is generally required to efficiently transmit signals over a communications channel, or to store compressed signals on a digital media device, such as a solid-state memory device or computer hard disk. Although there are many compression (or "coding") techniques, one method that has remained very popular for digital speech coding is known as Code Excited Linear Prediction (CELP), which is one of a family of "analysis-by-synthesis" coding algorithms. Analysis-by-synthesis generally refers to a coding process by which multiple parameters of a digital model are used to synthesize a set of candidate signals that are compared to an input signal and analyzed for distortion. A set of parameters that yield the lowest distortion is then either transmitted or stored, and eventually used to reconstruct an estimate of the original input signal. CELP is a particular analysis-by-synthesis method that uses one or more codebooks that each essentially comprises sets of code-vectors that are retrieved from the codebook in response to a codebook index.

In modern CELP coders, there is a problem with maintaining high quality speech and audio reproduction at reasonably low data rates. This is especially true for music or other generic audio signals that do not fit the CELP speech model very well. In this case, the model mismatch can cause severely degraded audio quality that can be unacceptable to an end user of the equipment that employs such methods. Therefore, there remains a need for improving performance of CELP type speech coders at low bit rates, especially for music and other non-speech type inputs.

DETAILED DESCRIPTION OF THE DRAWINGS

In order to address the above-mentioned need, a method and apparatus for generating an enhancement layer within an audio coding system is described herein. During operation an input signal to be coded is received and coded to produce a coded audio signal. The coded audio signal is then scaled with a plurality of gain values to produce a plurality of scaled coded audio signals, each having an associated gain value and a plurality of error values are determined existing between the input signal and each of the plurality of scaled coded audio signals. A gain value is then chosen that is associated with a scaled coded audio signal resulting in a low error value existing between the input signal and the scaled coded audio signal. Finally, the low error value is transmitted along with the gain value as part of an enhancement layer to the coded audio signal.

Figure 1:
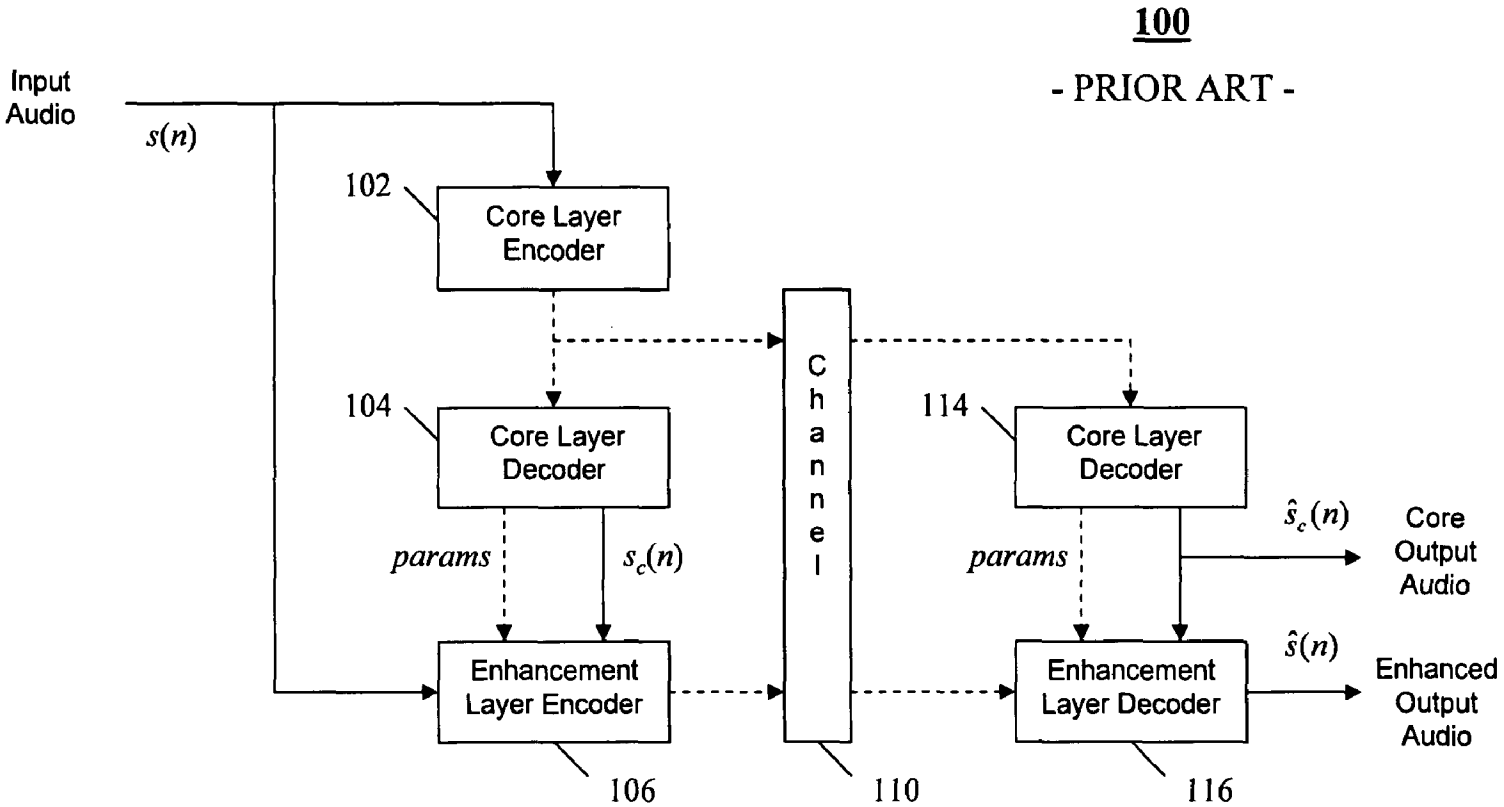
FIG. 1 is a block diagram of a prior art embedded speech/audio compression system.

A prior art embedded speech/audio compression system is shown in FIG. 1. The input audio s(n) is first processed by a core layer encoder 102, which for these purposes may be a CELP type speech coding algorithm. The encoded bit-stream is transmitted to channel 110, as well as being input to a local core layer decoder 104, where the reconstructed core audio signal $s_c(n)$ is generated. The enhancement layer encoder 106 is then used to code additional information based on some comparison of signals s(n) and $s_c(n)$, and may optionally use parameters from the core layer decoder 104. As in core layer decoder 104, core layer decoder 114 converts core layer bit-stream parameters to a core layer audio signal $\hat{s}_c(n)$. The enhancement layer decoder 116 then uses the enhancement layer bit-stream from channel 110 and signal $\hat{s}_c(n)$ to produce the enhanced audio output signal $\hat{s}(n)$.

The primary advantage of such an embedded coding system is that a particular channel 110 may not be capable of consistently supporting the bandwidth requirement associated with high quality audio coding algorithms. An embedded coder, however, allows a partial bit-stream to be received (e.g., only the core layer bit-stream) from the channel 110 to produce, for example, only the core output audio when the enhancement layer bit-stream is lost or corrupted. However, there are tradeoffs in quality between embedded vs. non-embedded coders, and also between different embedded coding optimization objectives. That is, higher quality enhancement layer coding can help achieve a better balance between core and enhancement layers, and also reduce overall data rate for better transmission characteristics (e.g., reduced congestion), which may result in lower packet error rates for the enhancement layers.

Figure 2:
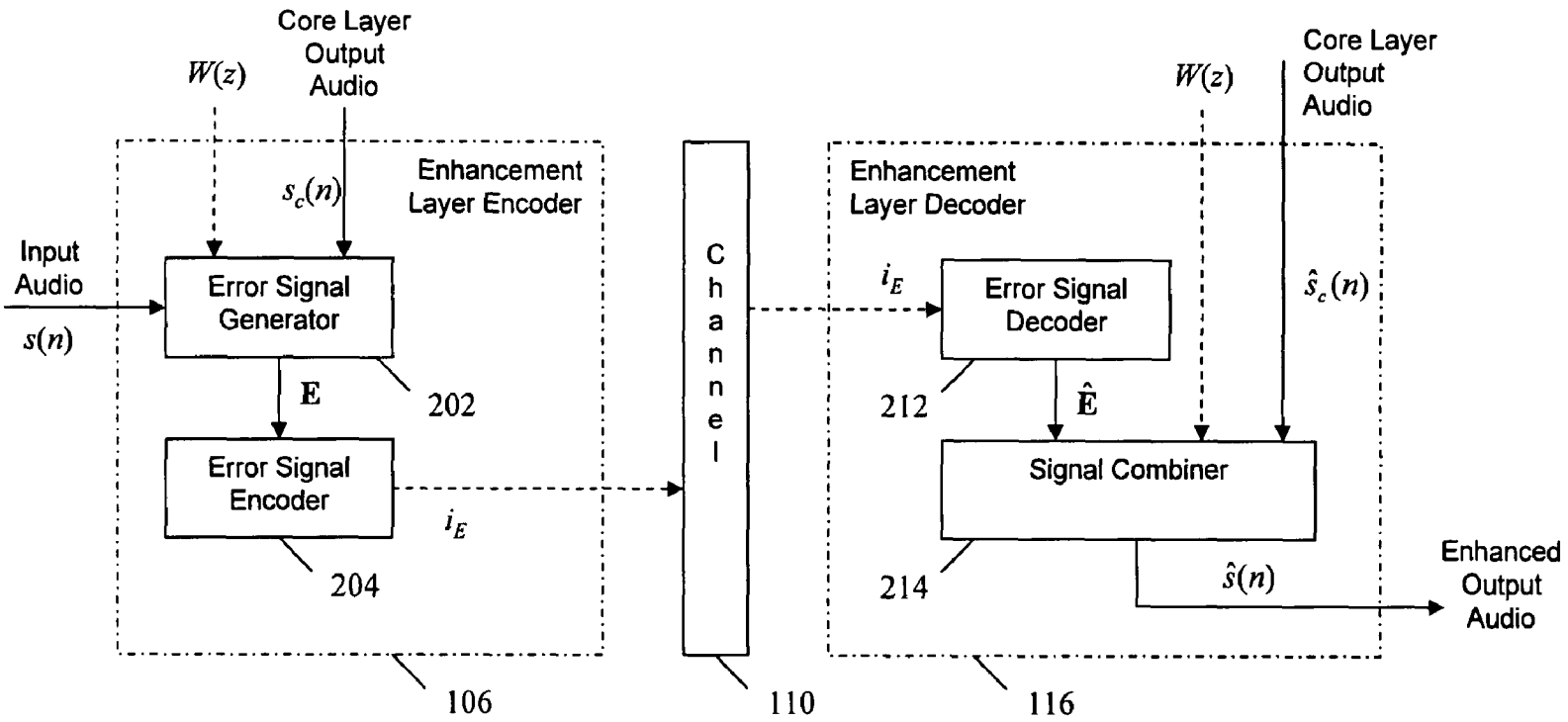
FIG. 2 is a more detailed example of the prior art enhancement layer encoder of FIG. 1.

A more detailed example of a prior art enhancement layer encoder 106 is given in FIG. 2. Here, the error signal generator 202 is comprised of a weighted difference signal that is transformed into the MDCT (Modified Discrete Cosine Transform) domain for processing by error signal encoder 204. The error signal E is given as:

$$E=MDCT\{W(s-s_c)\}, \tag{1}$$

where W is a perceptual weighting matrix based on the LP (Linear Prediction) filter coefficients A(z) from the core layer decoder 104, s is a vector (i.e., a frame) of samples from the input audio signal s(n), and $s_c$ is the corresponding vector of samples from the core layer decoder 104. An example MDCT process is described in ITU-T Recommendation G.729.1. The error signal E is then processed by the error signal encoder 204 to produce codeword $i_E$, which is subsequently transmitted to channel 110. For this example, it is important to note that error signal encoder 106 is presented with only one error signal E and outputs one associated codeword $i_E$. The reason for this will become apparent later.

The enhancement layer decoder 116 then receives the encoded bit-stream from channel 110 and appropriately demultiplexes the bit-stream to produce codeword $i_E$. The error signal decoder 212 uses codeword $i_E$ to reconstruct the enhancement layer error signal $\hat{E}$, which is then combined with the core layer output audio signal $\hat{s}_c(n)$ as follows, to produce the enhanced audio output signal $\hat{s}(n)$:

$$\hat{s}=s_c+W^{-1}MDCT^{-1}\{\hat{E}\}, \tag{2}$$

where $MDCT^{-1}$ is the inverse MDCT (including overlap-add), and $W^{-1}$ is the inverse perceptual weighting matrix.

Figure 3:
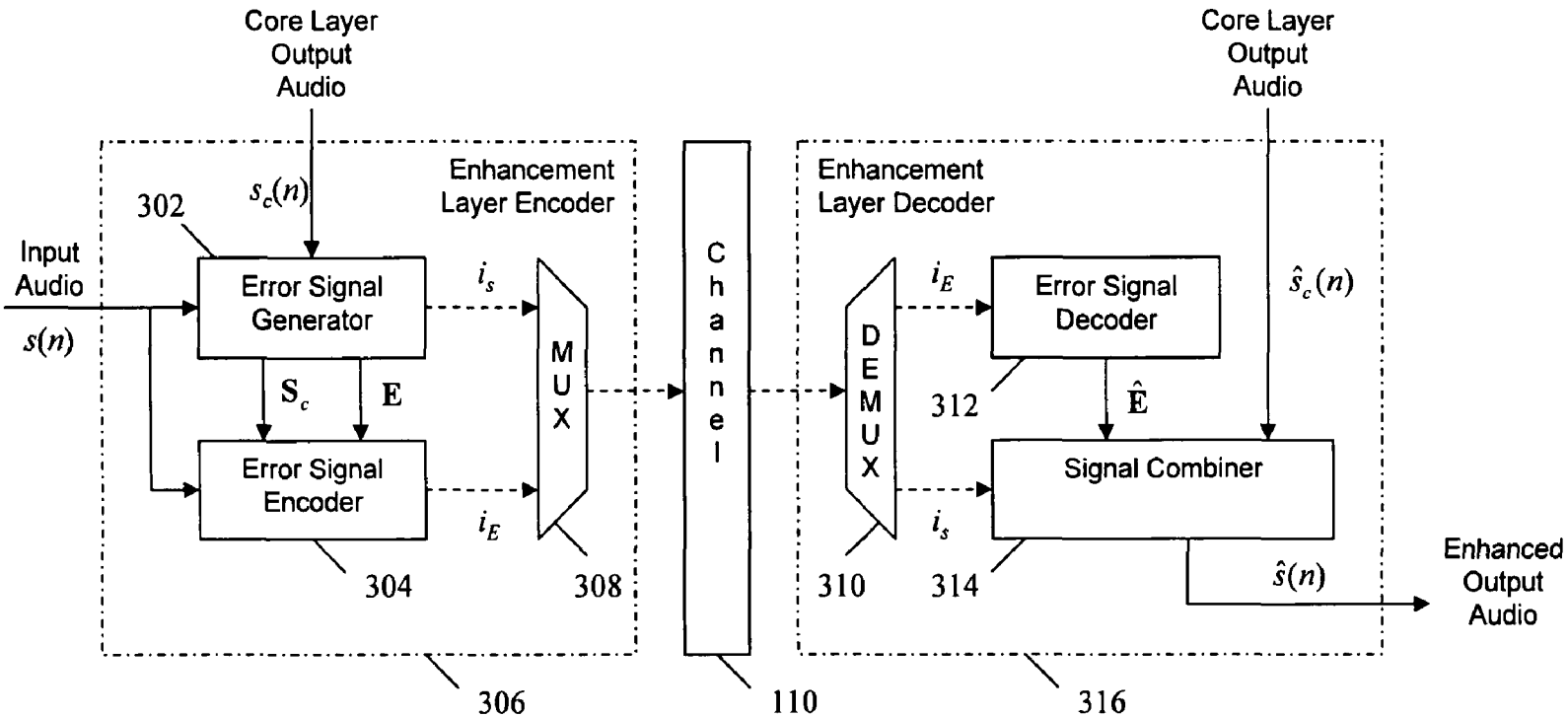
FIG. 3 is a more detailed example of the prior art enhancement layer encoder of FIG. 1.

Another example of an enhancement layer encoder is shown in FIG. 3. Here, the generation of the error signal E by error signal generator 302 involves adaptive pre-scaling, in which some modification to the core layer audio output $s_c(n)$ is performed. This process results in some number of bits to be generated, which are shown in enhancement layer encoder 106 as codeword $i_s$.

Additionally, enhancement layer encoder 106 shows the input audio signal s(n) and transformed core layer output audio $S_c$ being inputted to error signal encoder 304. These signals are used to construct a psychoacoustic model for improved coding of the enhancement layer error signal E. Codewords $i_s$ and $i_E$ are then multiplexed by MUX 308, and then sent to channel 110 for subsequent decoding by enhancement layer decoder 116. The coded bit-stream is received by demux 310, which separates the bit-stream into components $i_s$ and $i_E$. Codeword $i_E$ is then used by error signal decoder 312 to reconstruct the enhancement layer error signal $\hat{E}$. Signal combiner 314 scales signal $\hat{s}_c(n)$ in some manner using scaling bits $i_s$, and then combines the result with the enhancement layer error signal $\hat{E}$ to produce the enhanced audio output signal $\hat{s}(n)$.

Figure 4:
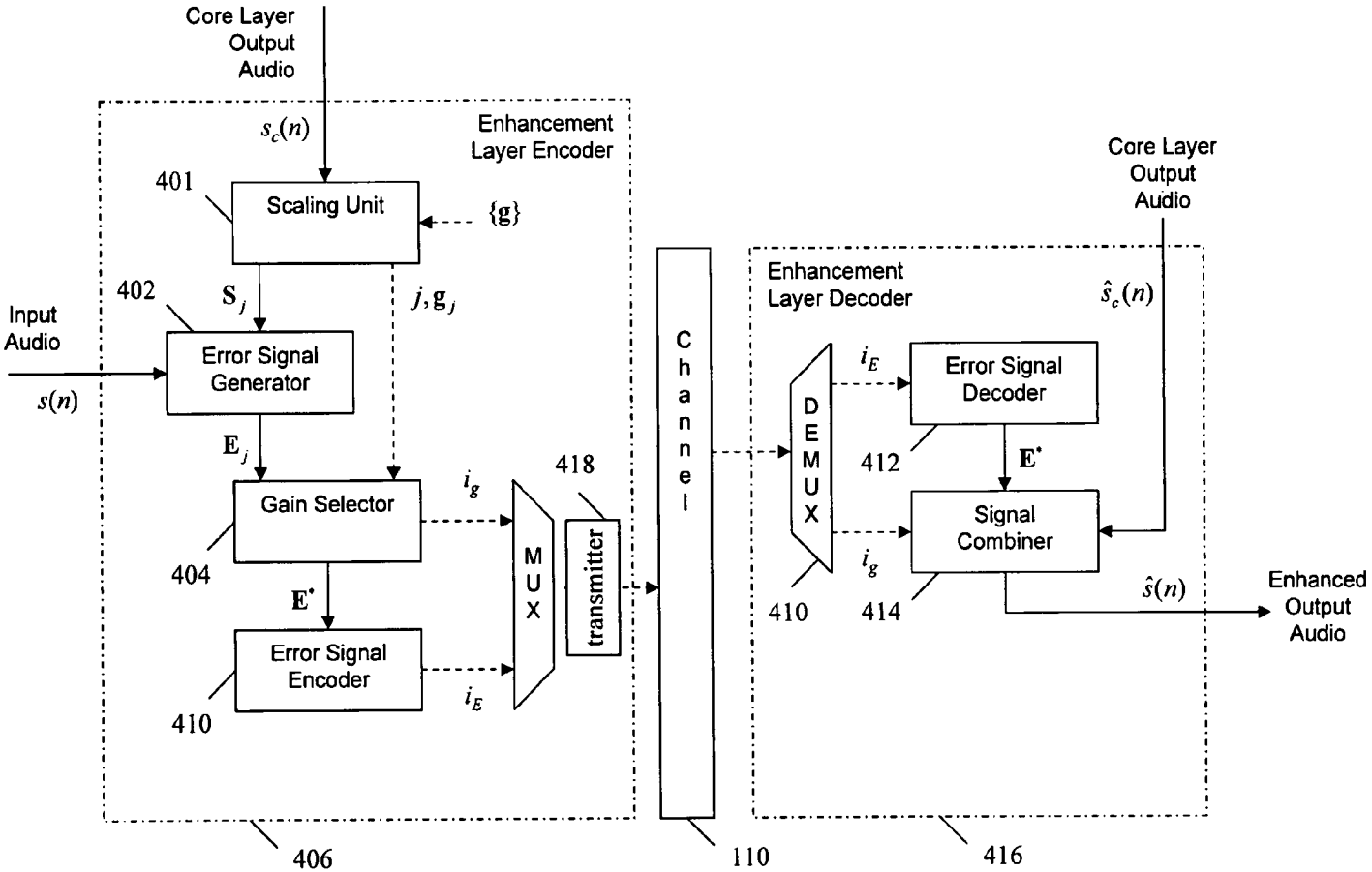
FIG. 4 is a block diagram of an enhancement layer encoder and decoder.

A first embodiment of the present invention is given in FIG. 4. This figure shows enhancement layer encoder 406 receiving core layer output signal $s_c(n)$ by scaling unit 401. A predetermined set of gains {g} is used to produce a plurality of scaled core layer output signals {S}, where $g_j$ and $S_j$ are the j-th candidates of the respective sets. Within scaling unit 401, the first embodiment processes signal $s_c(n)$ in the (MDCT) domain as:

$$S_j = G_j \times MDCT\{Ws_c\};\ 0 \leq j < M, \tag{3}$$

where W may be some perceptual weighting matrix, $s_c$ is a vector of samples from the core layer decoder 104, the MDCT is an operation well known in the art, and $G_j$ may be a gain matrix formed by utilizing a gain vector candidate $g_j$, and where M is the number gain vector candidates. In the first embodiment, $G_j$ uses vector $g_j$ as the diagonal and zeros everywhere else (i.e., a diagonal matrix), although many possibilities exist. For example, $G_j$ may be a band matrix, or may even be a simple scalar quantity multiplied by the identity matrix I. Alternatively, there may be some advantage to leaving the signal $S_j$ in the time domain or there may be cases where it is advantageous to transform the audio to a different domain, such as the Discrete Fourier Transform (DFT) domain. Many such transforms are well known in the art. In these cases, the scaling unit may output the appropriate $S_j$ based on the respective vector domain.

But in any case, the primary reason to scale the core layer output audio is to compensate for model mismatch (or some other coding deficiency) that may cause significant differences between the input signal and the core layer codec. For example, if the input audio signal is primarily a music signal and the core layer codec is based on a speech model, then the core layer output may contain severely distorted signal characteristics, in which case, it is beneficial from a sound quality perspective to selectively reduce the energy of this signal component prior to applying supplemental coding of the signal by way of one or more enhancement layers.

The gain scaled core layer audio candidate vector $S_j$ and input audio s(n) may then be used as input to error signal generator 402. In the preferred embodiment of the present invention, the input audio signal s(n) is converted to vector S such that S and $S_j$ are correspondingly aligned. That is, the vector s representing s(n) is time (phase) aligned with $s_c$, and the corresponding operations may be applied so that in the preferred embodiment:

$$E_j = MDCT\{Ws\} - S_j;\ 0 \leq j \leq M. \tag{4}$$

This expression yields a plurality of error signal vectors $E_j$ that represent the weighted difference between the input audio and the gain scaled core layer output audio in the MDCT spectral domain. In other embodiments where different domains are considered, the above expression may be modified based on the respective processing domain.

Gain selector 404 is then used to evaluate the plurality of error signal vectors $E_j$, in accordance with the first embodiment of the present invention, to produce an optimal error vector E*, an optimal gain parameter g*, and subsequently, a corresponding gain index $i_g$. The gain selector 404 may use a variety of methods to determine the optimal parameters, E* and g*, which may involve closed loop methods (e.g., minimization of a distortion metric), open loop methods (e.g., heuristic classification, model performance estimation, etc.), or a combination of both methods. In the preferred embodiment, a biased distortion metric may be used, which is given as the biased energy difference between the original audio signal vector S and the composite reconstructed signal vector:

$$j^* = \underset{0 \leq j < M}{\operatorname{argmin}}\{\beta_j \cdot \|S - (S_j + \hat{E}_j)\|^2\}, \tag{5}$$

where $\hat{E}_j$ may be the quantified estimate of the error signal vector $E_j$, and $\beta_j$ may be a bias term which is used to supplement the decision of choosing the perceptually optimal gain error index j*. An exemplary method for vector quantization of a signal vector is given in U.S. patent application Ser. No. 11/531,122, entitled APPARATUS AND METHOD FOR LOW COMPLEXITY COMBINATORIAL CODING OF SIGNALS, although many other methods are possible. Recognizing that $E_j = S - S_j$, equation (5) may be rewritten as:

$$j^* = \underset{0 \leq j < M}{\operatorname{argmin}}\{\beta_j \cdot \|E_j - \hat{E}_j\|^2\}. \tag{6}$$

In this expression, the term $\epsilon_j = \|E_j - \hat{E}_j\|^2$ represents the energy of the difference between the unquantized and quantized error signals. For clarity, this quantity may be referred to as the "residual energy", and may further be used to evaluate a "gain selection criterion", in which the optimum gain parameter g* is selected. One such gain selection criterion is given in equation (6), although many are possible.

The need for a bias term $\beta_j$ may arise from the case where the error weighting function W in equations (3) and (4) may not adequately produce equally perceptible distortions across vector $\hat{E}_j$. For example, although the error weighting function W may be used to attempt to "whiten" the error spectrum to some degree, there may be certain advantages to placing more weight on the low frequencies, due to the perception of distortion by the human ear. As a result of increased error weighting in the low frequencies, the high frequency signals may be under-modeled by the enhancement layer. In these cases, there may be a direct benefit to biasing the distortion metric towards values of $g_j$ that do not attenuate the high frequency components of $S_j$, such that the under-modeling of high frequencies does not result in objectionable or unnatural sounding artifacts in the final reconstructed audio signal. One such example would be the case of an unvoiced speech signal. In this case, the input audio is generally made up of mid to high frequency noise-like signals produced from turbulent flow of air from the human mouth. It may be that the core layer encoder does not code this type of waveform directly, but may use a noise model to generate a similar sounding audio signal. This may result in a generally low correlation between the input audio and the core layer output audio signals. However, in this embodiment, the error signal vector $E_j$ is based on a difference between the input audio and core layer audio output signals. Since these signals may not be correlated very well, the energy of the error signal $E_j$ may not necessarily be lower than either the input audio or the core layer output audio. In that case, minimization of the error in equation (6) may result in the gain scaling being too aggressive, which may result in potential audible artifacts.

In another case, the bias factors $\beta_j$ may be based on other signal characteristics of the input audio and/or core layer output audio signals. For example, the peak-to-average ratio of the spectrum of a signal may give an indication of that signal's harmonic content. Signals such as speech and certain types of music may have a high harmonic content and thus a high peak-to-average ratio. However, a music signal processed through a speech codec may result in a poor quality due to coding model mismatch, and as a result, the core layer output signal spectrum may have a reduced peak-to-average ratio when compared to the input signal spectrum. In this case, it may be beneficial reduce the amount of bias in the minimization process in order to allow the core layer output audio to be gain scaled to a lower energy thereby allowing the enhancement layer coding to have a more pronounced effect on the composite output audio. Conversely, certain types speech or music input signals may exhibit lower peak-to-average ratios, in which case, the signals may be perceived as being more noisy, and may therefore benefit from less scaling of the core layer output audio by increasing the error bias. An example of a function to generate the bias factors for $\beta_j$, is given as:

$$\beta_j = \begin{cases} 1 + 10^6 \cdot j; & UVSpeech = \text{TRUE or } \phi_S < \lambda\phi_{S_c} \\ 10^{(-j\cdot\Delta/10)}; & \text{otherwise} \end{cases}, \quad 0 \le j < M. \tag{7}$$

where $\lambda$ may be some threshold, and the peak-to-average ratio for vector $\phi_y$ may be given as:

$$\phi_y = \frac{\max\{|y_{k_1 k_2}|\}}{\frac{1}{k_2 - k_1 + 1}\sum_{k=k_1}^{k_2} |y(k)|}, \tag{8}$$

and where $y_{k_1 k_2}$ is a vector subset of y(k) such that $y_{k_1 k_2}$=y(k); $k_1 \leqq k \leqq k_2$.

Once the optimum gain index j* is determined from equation (6), the associated codeword $i_g$ is generated and the optimum error vector E* is sent to error signal encoder 410, where E* is coded into a form that is suitable for multiplexing with other codewords (by MUX 408) and transmitted for use by a corresponding decoder. In the preferred embodiment, error signal encoder 408 uses Factorial Pulse Coding (FPC). This method is advantageous from a processing complexity point of view since the enumeration process associated with the coding of vector E* is independent of the vector generation process that is used to generate $\hat{E}_j$.

Enhancement layer decoder 416 reverses these processes to produce the enhance audio output $\hat{s}(n)$. More specifically, $i_g$ and $i_E$ are received by decoder 416, with $i_E$ being sent to error signal decoder 412 where the optimum error vector E* is derived from the codeword. The optimum error vector E* is passed to signal combiner 414 where the received $\hat{s}_c(n)$ is modified as in equation (2) to produce $\hat{s}(n)$.

Figure 5:
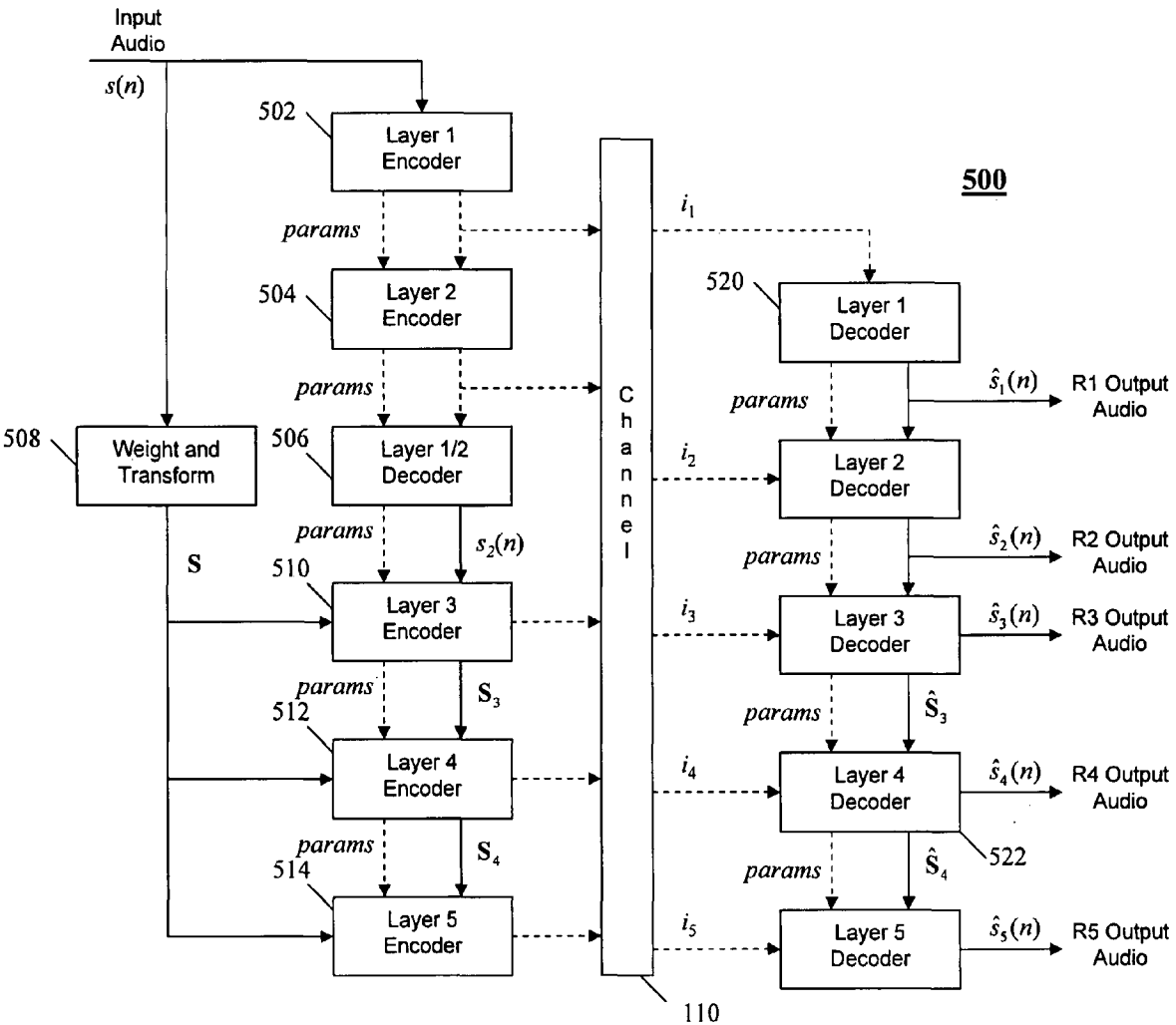
FIG. 5 is a block diagram of a multi-layer embedded coding system.

A second embodiment of the present invention involves a multi-layer embedded coding system as shown in FIG. 5. Here, it can be seen that there are five embedded layers given for this example. Layers 1 and 2 may be both speech codec based, and layers 3, 4, and 5 may be MDCT enhancement layers. Thus, encoders 502 and 503 may utilize speech codecs to produce and output encoded input signal s(n). Encoders 510, 512, and 514 comprise enhancement layer encoders, each outputting a differing enhancement to the encoded signal. Similar to the previous embodiment, the error signal vector for layer 3 (encoder 510) may be given as:

$$E_3 = S - S_2, \tag{9}$$

where S=MDCT{Ws} is the weighted transformed input signal, and $S_2$=MDCT{$Ws_2$} is the weighted transformed signal generated from the layer 1/2 decoder 506. In this embodiment, layer 3 may be a low rate quantization layer, and as such, there may be relatively few bits for coding the corresponding quantized error signal $\hat{E}_3$=Q{$E_3$}. In order to provide good quality under these constraints, only a fraction of the coefficients within $E_3$ may be quantized. The positions of the coefficients to be coded may be fixed or may be variable, but if allowed to vary, it may be required to send additional information to the decoder to identify these positions. If, for example, the range of coded positions starts at $k_s$ and ends at $k_e$, where $0 \leqq k_s < k_e < N$, then the quantized error signal vector $E_3$ may contain non-zero values only within that range, and zeros for positions outside that range. The position and range information may also be implicit, depending on the coding method used. For example, it is well known in audio coding that a band of frequencies may be deemed perceptually important, and that coding of a signal vector may focus on those frequencies. In these circumstances, the coded range may be variable, and may not span a contiguous set of frequencies. But at any rate, once this signal is quantized, the composite coded output spectrum may be constructed as:

$$S_3 = \hat{E}_3 + S_2, \tag{10}$$

which is then used as input to layer 4 encoder 512.

Layer 4 encoder 512 is similar to the enhancement layer encoder 406 of the previous embodiment. Using the gain vector candidate $g_j$, the corresponding error vector may be described as:

$$E_4(j) = S - G_j S_3, \tag{11}$$

where $G_j$ may be a gain matrix with vector $g_j$ as the diagonal component. In the current embodiment, however, the gain vector $g_j$ may be related to the quantized error signal vector $\hat{E}_3$ in the following manner. Since the quantized error signal vector $\hat{E}_3$ may be limited in frequency range, for example, starting at vector position $k_s$ and ending at vector position $k_e$, the layer 3 output signal $S_3$ is presumed to be coded fairly accurately within that range. Therefore, in accordance with the present invention, the gain vector $g_j$ is adjusted based on the coded positions of the layer 3 error signal vector, $k_s$ and $k_e$. More specifically, in order to preserve the signal integrity at those locations, the corresponding individual gain elements may be set to a constant value $\alpha$. That is:

$$g_j(k) = \begin{cases} \alpha; & k_s \le k \le k_e \\ \gamma_j(k); & \text{otherwise,} \end{cases} \tag{12}$$

where generally $0 \leqq \gamma_j(k) \leqq 1$ and $g_j(k)$ is the gain of the k-th position of the j-th candidate vector. In the preferred embodiment, the value of the constant is one ($\alpha=1$), however many values are possible. In addition, the frequency range may span multiple starting and ending positions. That is, equation (12) may be segmented into non-continuous ranges of varying gains that are based on some function of the error signal $\hat{E}_3$, and may be written more generally as:

$$g_j(k) = \begin{cases} \alpha; & \hat{E}_3(k) \ne 0 \\ \gamma_j(k); & \text{otherwise,} \end{cases} \tag{13}$$

For this example, a fixed gain $\alpha$ is used to generate $g_j(k)$ when the corresponding positions in the previously quantized error signal $\hat{E}_3$ are non-zero, and gain function $\gamma_j(k)$ is used when the corresponding positions in $\hat{E}_3$ are zero. One possible gain function may be defined as:

$$\gamma_j(k) = \begin{cases} \alpha \cdot 10^{(-j \cdot \Delta/20)}; & k_l \le k \le k_h \\ \alpha; & \text{otherwise} \end{cases}, \; 0 \le j < M, \tag{14}$$

where $\Delta$ is a step size (e.g., $\Delta \approx 2.2$ dB), $\alpha$ is a constant, M is the number of candidates (e.g., M=4, which can be represented using only 2 bits), and $k_l$ and $k_h$ are the low and high frequency cutoffs, respectively, over which the gain reduction may take place. The introduction of parameters $k_l$ and $k_h$ is useful in systems where scaling is desired only over a certain frequency range. For example, in a given embodiment, the high frequencies may not be adequately modeled by the core layer, thus the energy within the high frequency band may be inherently lower than that in the input audio signal. In that case, there may be little or no benefit from scaling the layer 3 output in that region signal since the overall error energy may increase as a result.

Summarizing, the plurality of gain vector candidates $g_j$ is based on some function of the coded elements of a previously coded signal vector, in this case $\hat{E}_3$. This can be expressed in general terms as:

$$g_j(k) = f(k, \hat{E}_3). \tag{15}$$

The corresponding decoder operations are shown on the right hand side of FIG. 5. As the various layers of coded bit-streams ($i_1$ to $i_5$) are received, the higher quality output signals are built on the hierarchy of enhancement layers over the core layer (layer 1) decoder. That is, for this particular embodiment, as the first two layers are comprised of time domain speech model coding (e.g., CELP) and the remaining three layers are comprised of transform domain coding (e.g., MDCT), the final output for the system $\hat{s}(n)$ is generated according to the following:

$$\hat{s}(n) = \begin{cases} \hat{s}_1(n); \\ \hat{s}_2(n) = \hat{s}_1(n) + \hat{e}_2(n); \\ \hat{s}_3(n) = W^{-1} MDCT^{-1}\{\hat{S}_2 + \hat{E}_3\}; \\ \hat{s}_4(n) = W^{-1} MDCT^{-1}\{G_j \cdot (\hat{S}_2 + \hat{E}_3) + \hat{E}_4\}; \\ \hat{s}_5(n) = W^{-1} MDCT^{-1}\{G_j \cdot (\hat{S}_2 + \hat{E}_3) + \hat{E}_4 + \hat{E}_5\};, \end{cases} \tag{16}$$

where $\hat{e}_2(n)$ is the layer 2 time domain enhancement layer signal, and $\hat{S}_2 = MDCT\{Ws_2\}$ is the weighted MDCT vector corresponding to the layer 2 audio output $\hat{s}_2(n)$. In this expression, the overall output signal $\hat{s}(n)$ may be determined from the highest level of consecutive bit-stream layers that are received. In this embodiment, it is assumed that lower level layers have a higher probability of being properly received from the channel, therefore, the codeword sets $\{i_1\}$, $\{i_1 i_2\}$, $\{i_1 i_2 i_3\}$, etc., determine the appropriate level of enhancement layer decoding in equation (16).

Figure 6:
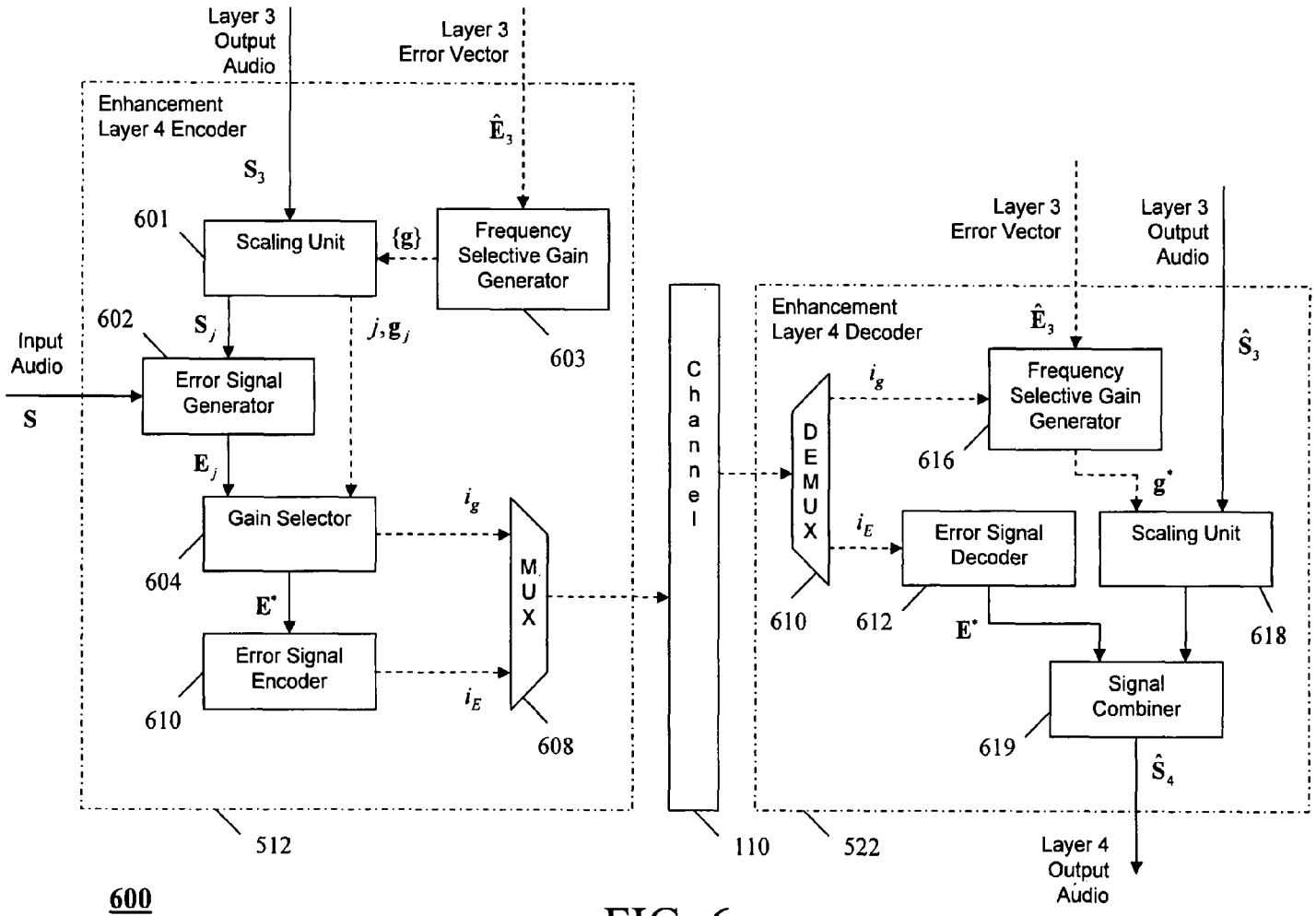
FIG. 6 is a block diagram of layer-4 encoder and decoder.

FIG. 6 is a block diagram showing layer 4 encoder 512 and decoder 522. The encoder and decoder shown in FIG. 6 are similar to those shown in FIG. 4, except that the gain value used by scaling units 601 and 618 is derived via frequency selective gain generators 603 and 616, respectively. During operation layer 3 audio output $S_3$ is output from layer 3 encoder and received by scaling unit 601. Additionally, layer 3 error vector $\hat{E}_3$ is output from layer 3 encoder 510 and received by frequency selective gain generator 603. As discussed, since the quantized error signal vector $\hat{E}_3$ may be limited in frequency range, the gain vector $g_j$ is adjusted based on, for example, the positions $k_s$ and $k_e$ as shown in equation 12, or the more general expression in equation 13.

The scaled audio $S_j$ is output from scaling unit 601 and received by error signal generator 602. As discussed above, error signal generator 602 receives the input audio signal S and determines an error value $E_j$ for each scaling vector utilized by scaling unit 601. These error vectors are passed to gain selector circuitry 604 along with the gain values used in determining the error vectors and a particular error E* based on the optimal gain value g*. A codeword ($i_g$) representing the optimal gain g* is output from gain selector 604, along with the optimal error vector E*, is passed to encoder 610 where codeword $i_E$ is determined and output. Both $i_g$ and $i_E$ are output to multiplexer 608 and transmitted via channel 110 to layer 4 decoder 522.

Figure 7:
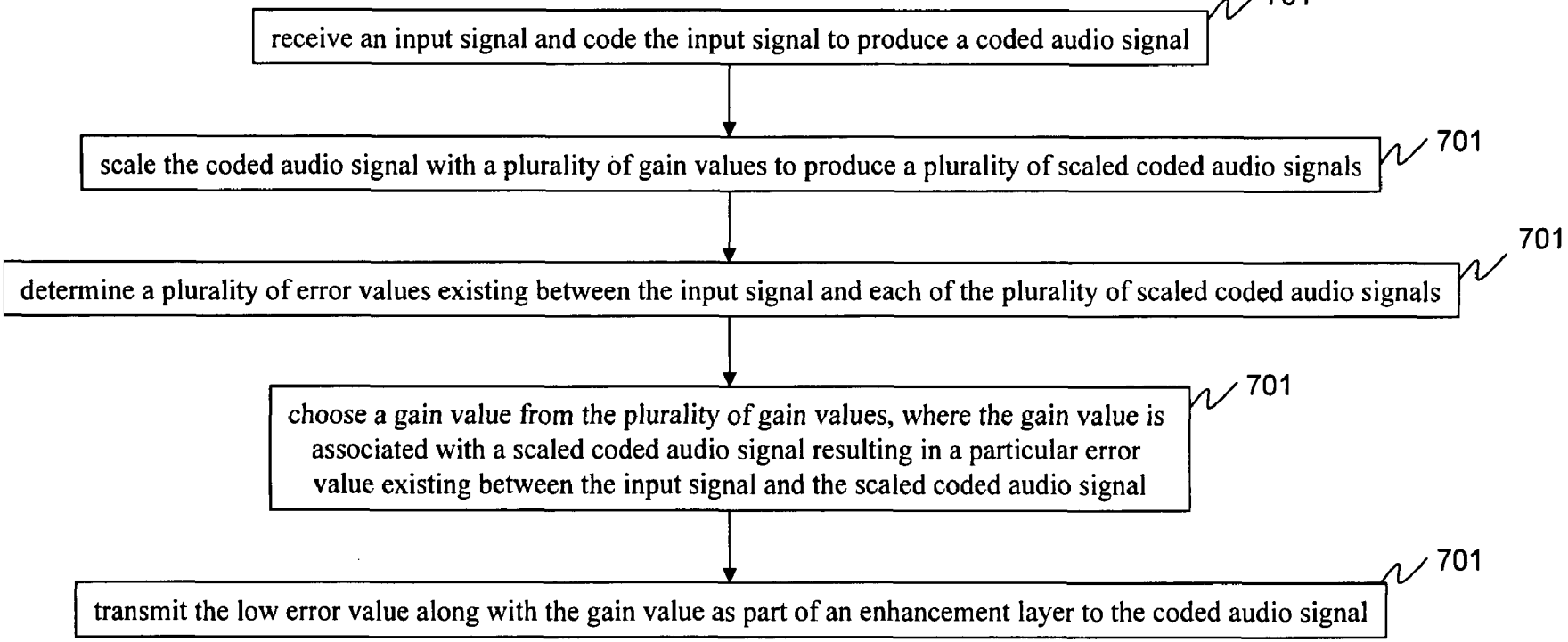
FIG. 7 is a flow chart showing operation of the encoders of FIG. 4 and FIG. 6.

During operation of layer 4 decoder 522, $i_g$ and $i_E$ are received and demultiplexed. Gain codeword $i_g$ and the layer 3 error vector $\hat{E}_3$ are used as input to the frequency selective gain generator 616 to produce gain vector g* according to the corresponding method of encoder 512. Gain vector g* is then applied to the layer 3 reconstructed audio vector $\hat{S}_3$ within scaling unit 618, the output of which is then combined with the layer 4 enhancement layer error vector E*, which was obtained from error signal decoder 612 through decoding of codeword $i_E$, to produce the layer 4 reconstructed audio output $\hat{S}_4$. FIG. 7 is a flow chart showing the operation of an encoder according to the first and second embodiments of the present invention. As discussed above, both embodiments utilize an enhancement layer that scales the encoded audio with a plurality of scaling values and then chooses the scaling value resulting in a lowest error. However, in the second embodiment of the present invention, frequency selective gain generator 603 is utilized to generate the gain values.

The logic flow begins at step 701 where a core layer encoder receives an input signal to be coded and codes the input signal to produce a coded audio signal. Enhancement layer encoder 406 receives the coded audio signal ($s_c(n)$) and scaling unit 401 scales the coded audio signal with a plurality of gain values to produce a plurality of scaled coded audio signals, each having an associated gain value. (step 703). At step 705, error signal generator 402 determines a plurality of error values existing between the input signal and each of the plurality of scaled coded audio signals. Gain selector 404 then chooses a gain value from the plurality of gain values (step 707). As discussed above, the gain value (g*) is associated with a scaled coded audio signal resulting in a low error value (E*) existing between the input signal and the scaled coded audio signal. Finally at step 709 transmitter 418 transmits the low error value (E*) along with the gain value (g*) as part of an enhancement layer to the coded audio signal. As one of ordinary skill in the art will recognize, both E* and g* are properly encoded prior to transmission.

As discussed above, at the receiver side, the coded audio signal will be received along with the enhancement layer. The enhancement layer is an enhancement to the coded audio signal that comprises the gain value (g*) and the error signal (E*) associated with the gain value.

While the invention has been particularly shown and described with reference to a particular embodiment, it will be understood by those skilled in the art that various changes in form and details may be made therein without departing from the spirit and scope of the invention. For example, while the above techniques are described in terms of transmitting and receiving over a channel in a telecommunications system, the techniques may apply equally to a system which uses the signal compression system for the purposes of reducing storage requirements on a digital media device, such as a solid-state memory device or computer hard disk. It is intended that such changes come within the scope of the following claims.

The invention claimed is:

1. A method for an embedded audio encoder to embed coding of a signal, comprising the steps of:

the embedded audio encoder receiving an input signal to be coded;

a first layer of the embedded audio encoder coding the input signal to produce a first layer reconstructed audio signal;

a second layer of the embedded audio encoder scaling the first layer reconstructed audio signal with a plurality of gain values to produce a plurality of scaled reconstructed audio signals, wherein the plurality of gain values are a function of the first layer reconstructed audio signal and further, wherein each of the plurality of scaled reconstructed audio signals has an associated gain value;

the second layer of the embedded audio encoder determining a plurality of error values based on the input signal and each of the plurality of scaled reconstructed audio signals;

the second layer of the audio encoder choosing a gain value from the plurality of gain values based on the plurality of error values; and the embedded audio encoder transmitting or storing the gain value as part of an enhancement layer to a coded audio signal.

2. The method of claim 1 wherein the plurality of gain values comprise frequency selective gain values.

3. The method of claim 1 wherein the first layer of the embedded audio encoder comprises a Code Excited Linear Prediction (CELP) encoder.

4. A method for an embedded audio decoder receiving a coded audio signal and an enhancement to the coded audio signal, the method comprising the steps of:

a first layer of the embedded audio decoder receiving the coded audio signal; and a second layer of the audio decoder receiving the enhancement to the coded audio signal, wherein the enhancement to the coded audio signal comprises a gain value and an error signal associated with the gain value, wherein the gain value was chosen by a transmitter from a plurality of gain values, wherein the gain value is associated with a scaled reconstructed audio signal resulting in a particular error value existing between an audio signal and the scaled reconstructed audio signal; and the audio decoder enhancing the coded audio signal based on the gain value and the error value.

5. The method of claim 4 wherein the gain value comprises a frequency selective gain value.

6. The method of claim 5 wherein the frequency selective gain values $$g_j(k) = \begin{cases} \alpha; & k_s \le k \le k_e \\ \gamma_j(k); & \text{otherwise,} \end{cases}$$

where generally $0 \leqq \gamma_j(k) \leqq 1$ and $g_j(k)$ is the gain of a k-th position of a j-th candidate vector.

7. A method of claim 5 wherein the first layer of the embedded audio decoder comprises a Code Excited Linear Prediction (CELP) decoder.

8. A method of claim 5 wherein the embedded decoder comprises a third layer wherein the third layer is between the first layer and the second layer, and wherein the third layer outputs a frequency domain error vector.

9. An apparatus comprising:

an embedded encoder receiving an input signal to be coded, wherein the embedded encoder comprises:

a first layer of the embedded audio encoder coding the input signal to produce a first layer reconstructed audio signal;

a second layer of the embedded encoder scaling the first layer reconstructed audio signal with a plurality of gain values to produce a plurality of scaled reconstructed audio signals, wherein the plurality of gain values are a function of the first layer reconstructed audio signal and further, wherein each of the plurality of scaled reconstructed audio signals has an associated gain value, wherein the second layer of the embedded encoder determines a plurality of error values existing between the input signal and each of the plurality of scaled reconstructed audio signals, wherein the second layer of the embedded encoder choosing a gain value from the plurality of gain values, and further, wherein the gain value is chosen based on the plurality of error values existing between the input signal and the scaled reconstructed audio signal; and a transmitter transmitting the selected gain value as part of an enhancement layer to a coded audio signal.

10. The apparatus of claim 9 wherein the plurality of gain values comprise frequency selective gain values.

11. The apparatus of claim 10 wherein the frequency selective gain values $$g_j(k) = \begin{cases} \alpha; & k_s \le k \le k_e \\ \gamma_j(k); & \text{otherwise,} \end{cases}$$

where generally $0 \leqq \gamma_j(k) \leqq 1$ and $g_j(k)$ is the gain of a k-th position of a j-th candidate vector.

12. An apparatus comprising:

a first layer of an embedded decoder receiving a coded audio signal; and a second layer of the embedded layer decoder receiving enhancement to the coded audio signal and producing an enhanced audio signal, wherein the enhancement to the coded audio signal comprises a gain value and an error signal associated with the gain value, wherein the gain value was chosen by an encoder from a plurality of gain values, wherein the gain value is associated with a scaled reconstructed audio signal resulting in a particular error value existing between an input audio signal and the scaled reconstructed audio signal.

13. An apparatus comprising:

a first layer of an embedded decoder receiving codewords to produce a reconstructed audio signal; and a second layer of the embedded decoder receiving codewords for enhancement to the coded audio signal and outputting an enhanced reconstructed audio signal, wherein the enhancement to the reconstructed audio signal comprises a frequency selective gain value and an error signal associated with the gain value, wherein the frequency selective gain value is based on the reconstructed audio signal.

14. The method of claim 13 wherein the frequency domain comprises the MDCT domain.

15. The method of claim 13 wherein the step of receiving the enhancement further comprises:

receiving a gain codeword $i_g$; and generating the frequency selective gain vector based on the gain codeword and the first error value.

16. The method of claim 13 wherein the frequency selective gain value comprises $g_j(k)$, wherein $g_j(k)$ is the gain of a k-th frequency component of a j-th candidate vector.

17. A method of claim 13 where in the frequency selective gain is based on the frequency domain error vector $\hat{E}_3$.

* * * * *